US009283611B2

(12) United States Patent
Haar

(10) Patent No.: US 9,283,611 B2
(45) Date of Patent: Mar. 15, 2016

(54) METHOD AND DEVICE FOR DEEP DRAWING BLANKS MADE OF SHEET METAL INTO FLANGELESS MOULDED BLANKS

(75) Inventor: Thomas Haar, Halstenbek (DE)

(73) Assignee: Saeta GmbH & Co KG, Wedel (DE)

( * ) Notice: Subject to any disclaimer, the term of this patent is extended or adjusted under 35 U.S.C. 154(b) by 770 days.

(21) Appl. No.: 12/525,261

(22) PCT Filed: Nov. 11, 2007

(86) PCT No.: PCT/EP2007/010053

§ 371 (c)(1),
(2), (4) Date: Feb. 19, 2010

(87) PCT Pub. No.: WO2008/092486

PCT Pub. Date: Aug. 7, 2008

(65) Prior Publication Data

US 2010/0139357 A1 Jun. 10, 2010

(30) Foreign Application Priority Data

Feb. 1, 2007 (DE) ..... 10 2007 005 011

(51) Int. Cl.
*B21D 24/14* (2006.01)
*B21D 22/22* (2006.01)

(52) U.S. Cl.
CPC ..... *B21D 24/14* (2013.01); *B21D 22/22* (2013.01)

(58) Field of Classification Search
CPC ..... B21D 22/20; B21D 24/02; B21D 24/04; B21D 24/06; B21D 24/08; B21D 24/10; B21D 24/12; B21D 24/14; F15B 15/204; F15B 11/02; F15B 15/22
USPC ..... 72/347, 350, 351, 453.01–453.19; 100/269.02–269.16; 91/404–408
See application file for complete search history.

(56) References Cited

U.S. PATENT DOCUMENTS

| | | | | | |
|---|---|---|---|---|---|
| 1,431,175 | A | * | 10/1922 | Ogden et al. | 72/336 |
| 2,300,162 | A | * | 10/1942 | Maude | 267/119 |
| 3,202,411 | A | * | 8/1965 | Heiser | 267/119 |
| 3,286,496 | A | * | 11/1966 | Burk | 72/54 |
| 3,908,429 | A | * | 9/1975 | Gram | 72/349 |
| 4,361,020 | A | * | 11/1982 | Hirota et al. | 72/57 |
| 4,470,287 | A | * | 9/1984 | Antonov et al. | 72/347 |

(Continued)

FOREIGN PATENT DOCUMENTS

| | | |
|---|---|---|
| DE | 1 602 515 | 4/1970 |
| DE | 4230716 A1 | 3/1994 |

(Continued)

*Primary Examiner* — David Bryant
*Assistant Examiner* — Lawrence Averick
(74) *Attorney, Agent, or Firm* — Vidas, Arrett & Steinkraus, P.A.

(57) ABSTRACT

A method for deep drawing blanks, which are punched out of sheet metal that is painted or coated with film material, for example made of steel or aluminum, into flangeless molded blanks, wherein the blanks are formed to a crucible-shaped part, with a flangeless cylindrical edge, around a drawing core by means of a drawing bell of a drawing die, and a predetermined spring force is applied to the side of the edge opposite to the drawing bell during the forming of the edge of the blanks by means of a blank holder, characterized in that the spring force applied to the blank holder is spontaneously reduced substantially to zero shortly before the end of the drawing process.

14 Claims, 1 Drawing Sheet

(56) References Cited

U.S. PATENT DOCUMENTS

| | | | | |
|---|---|---|---|---|
| 4,601,190 | A * | 7/1986 | Schneider et al. | 72/347 |
| 5,209,099 | A * | 5/1993 | Saunders | 72/349 |
| 5,339,665 | A * | 8/1994 | Yoshikawa | 72/20.1 |
| 5,433,099 | A | 7/1995 | Katsuhiro et al. | |
| 5,457,980 | A * | 10/1995 | Kirii et al. | 72/351 |
| 5,588,641 | A * | 12/1996 | Sand | 267/119 |
| 5,794,482 | A * | 8/1998 | Walkin | 72/350 |
| 5,901,599 | A * | 5/1999 | Sato et al. | 72/350 |
| 2006/0260379 | A1* | 11/2006 | Cappeller et al. | 72/350 |
| 2007/0012083 | A1* | 1/2007 | Iwashita et al. | 72/350 |
| 2007/0214858 | A1* | 9/2007 | Campo et al. | 72/348 |
| 2010/0139357 | A1* | 6/2010 | Haar | 72/347 |
| 2011/0036140 | A1* | 2/2011 | Miyasaka et al. | 72/351 |

FOREIGN PATENT DOCUMENTS

| | | | |
|---|---|---|---|
| DE | 692 06 748 | T2 | 12/1995 |
| DE | 19653270 | A1 | 6/1998 |
| DE | 19756911 | A1 | 6/1999 |
| DE | 19954310 | A1 | 5/2001 |
| DE | 103 41 224 | | 4/2005 |
| EP | 0 536 952 | | 4/1993 |
| EP | 0595417 | A1 | 5/1994 |
| EP | 1844871 | A2 | 10/2007 |

* cited by examiner

METHOD AND DEVICE FOR DEEP DRAWING BLANKS MADE OF SHEET METAL INTO FLANGELESS MOULDED BLANKS

CROSS-REFERENCE TO RELATED APPLICATIONS

Not applicable

STATEMENT REGARDING FEDERALLY SPONSORED RESEARCH

Not applicable

BACKGROUND OF THE INVENTION

Caps for containers are usually produced in that blanks that are punched out from sheet metal plates are deep drawn in a deep drawing die, whereby approximately crucible-shaped moulded blanks are formed with a ceiling- and an edge portion. Of course, a compression of the material in the edge portion takes place in this due to the reduction of the diameter. Because the used material, steel or aluminium in particular, has a given texture, small projections are formed on the free edge in such a drawing process. So called scallops or ears are formed (earing).

In caps for containers that receive delicate material or that are filled with a corrosion-promoting content, it is known to paint the inner side of such caps or to provide it with another coating, for instance with film material. The coating takes place on the sheet metal already, i.e. on the sheet metal web or the sheet metal plates that are to be punched. In this, fine pieces of fluff or hair-like formations are formed on the cylindrical or flangeless edge of the deep drawn cap, which are considered to be extremely disadvantageous. The reason is on the one hand that such "fluffs" strongly soil the die. On the other hand, they can contaminate the contents of a container in the later utilisation of the cap.

A typical deep draw die for deep drawing flat blanks in order to form caps provides a drawing bell and a drawing core, round about which the drawing bell forms the crucible-shaped moulded blank. Because of the already described diameter reduction, creases can be formed on the edge. Therefore, such a deep draw die provides a so-called blank holder, which bears against the edge region under a spring force. In this, the inner side of the edge region is located on the blank holder, and thereby it bears against the layer of paint or film material. In the art, it is assumed that the breaking of the material at the end of the punching process, which is inevitable with harder sheet metal in particular, is the reason of the fraying of the layer.

From EP 0 595 417 B1, a spring device for a blank holder of a drawing die has become known, by which the force of the blank holder applied to the flange of the moulded blank is reduced in the progression of the deep drawing process. As is well known, the pressure intensity between blank holder and moulded blank increases in the progression of the deformation process even at constant force on the blank holder, because the area of the edge region of the moulded blank that co-operates with the blank holder decreases progressively. By successive reduction of the force on the blank holder, it is intended to keep the pressure intensity approximately constant in the known case.

From U.S. Pat. No. 5,433,099, a method has become known for deep drawing blanks which are punched out of sheet metal that is painted or coated with film material, for example made of steel or aluminium, into flangeless moulded blanks, wherein the blanks are deformed to a crucible-shaped part with a flangeless cylindrical edge, round about a drawing core by means of a drawing bell of a drawing die, and a predetermined spring force is applied to the side of the edge opposite to the drawing bell during the forming of the edge of the blanks by means of a blank holder. The spring force applied to the blank holder is spontaneously reduced substantially to zero shortly before the end of the drawing process.

From EP-A-0 595 417, a drawing die for deep drawing blanks has become known, with a drawing bell, a drawing core, a blank holder or a pneumatic spring which applies a spring force to the blank holder.

BRIEF SUMMARY OF THE INVENTION

The present invention is based on the objective to provide a device for deep drawing flat blanks into crucible-shaped, flangeless moulded blanks, wherein the blanks are punched out of a sheet metal that is painted or coated with film material, in which the generation of paint hairs and similar phenomena is avoided.

In the device of the present invention, the spring force applied to the blank holder is spontaneously reduced substantially to zero shortly before the end of the drawing process.

It has proven that the generation of paint hairs is avoided in flangeless moulded blanks when the force applied to the blank holder is taken off imminently before the completion of the drawing process, i.e. when the edge or the corner, respectively, of the edge portion bears against the blank holder substantially without pressure. In the present context, flangeless means that the edge of the moulded blank does not have a flange on the free corner, i.e. the edge is cylindrical.

The device according to the present invention is based on the finding that paint or film material is released from the base material in the edge region while the blanks from the sheet metal are punched out. The punching out of the blanks is either performed beforehand or simultaneously with the deep drawing, in that the deep drawing bell effects the punching out process. In conventional deep drawing, the blank holder comes into contact with this released edge region of the coating and causes no "chewing action" in that moment in which the sheet metal to be drawn leaves the blank holder. Thus, this causes a more or less strong destruction of this released edge region, which leads to the formation of the paint hairs that were already mentioned several times.

It is decisive for the device of the present invention that the spring force applied to the blank holder is made zero in a high degree, namely within a very short time, for instance within milliseconds. The point of time on which the spring force on the blank holder is eliminated can be adjusted by the position of the blank holder or of the drawing bell, respectively. Of course this position depends on the geometry of the moulded blank that is to be produced.

As indicated above, it is known to provide the force on the blank holder by a pneumatic force, by a gas cushion for instance, which is closed up by a piston, which on its part bears against the blank holder by way of suitable force transmission elements. In such a realisation, the gas cushion is vented towards the atmosphere when the spring force is to be eliminated.

After the venting of the gas cushion, the space receiving the gas cushion has to be filled with gas anew, in order to provide the spring force for the next drawing process.

In the known device, the spring force is successively reduced during the drawing process, in order to achieve an approximately constant pressure between the blank holder and the edge of the moulded blank. In the present invention it has been found that a reduction of the spring force during the drawing process does not bring about any advantages. To the contrary, in the present invention the spring force is allowed to increase linearly during the drawing process, up to the spontaneous fall-off. This is automatically the case when the volume of a gas cushion is continuously reduced during the drawing process. The pressure intensities during the drawing process are increased thereby, which partly compensates the phenomenon however that the edge region becomes thicker in the progressive deformation thereof, and thus a higher spring force is necessary to counter-act the formation of creases.

In the drawing die according to the present invention, the pneumatic spring is formed by a gas volume in a chamber, which is closed up by a piston. The piston on its part acts on the blank holder by way of force transmission elements, and a venting valve is associated to the chamber, which is actuated when the piston has reached a given lower position, whereby the chamber is suddenly vented. In order to actuate the valve, a bar or a lever can be associated to the venting valve according to one embodiment of the present invention, which is arranged in the chamber and can be actuated by the piston.

Because a new build-up of pressure by ventilation is necessary after the venting of the chamber, according to one embodiment of the present invention, a pressure source is provided which can be connected to the chamber via an air valve. A control device actuates the air valve after the completion of the drawing process. Thereby, the piston and the blank holder are adjusted to an upper position automatically and are then ready for the next drawing process.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
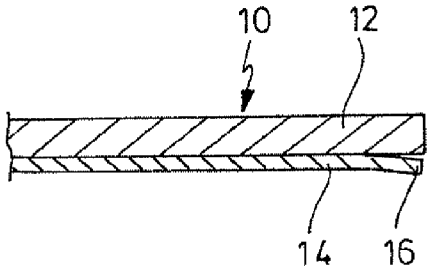
FIG. 1 shows in a schematic view a section through a blank for the production of a cylindrical moulded blank.

A not necessarily annular blank 10 in FIG. 1 consists of a base material 12 and a coating 14. The base material consists of steel- or aluminium sheet, for instance. The coating 14 is a paint, a plastics film or the like, for instance. At 16 it is shown how the coating has been released from the base material 12 on the edge of the blank. Such a process occurs when the blank 10 is punched out of the coated metal sheet.

Figure 2:
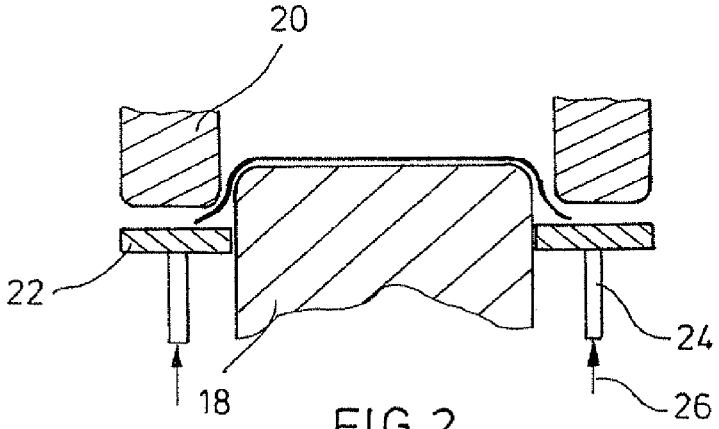
FIG. 2 shows in a schematic view a drawing die during a drawing process with a blank after FIG. 1.

The deep draw die after FIG. 2 has a for instance cylindrical drawing core 18, a ring-cylindrical drawing bell 20 and a ring disc shaped blank holder 22. Such a construction of a deep drawing die is commonly known. The drawing core 18 is for instance stationary, whereas the drawing bell 20 is coupled with the aid of a suitable pressing device, the push bar of a lever press for instance. On its lower side, the blank holder 22 is in contact with force transmission elements 24, which are a part of a spring device. The spring forces acting on the force transmission elements 24 are indicated at 26 in FIG. 2

In FIG. 2 it is indicated how the blank 10 is deep drawn by progressively forming the edge region approximately round about the drawing core 18 with the aid of the drawing bell 20. The blank holder 22 bears against the "inner side" of the moulded blank and prevents the formation of creases in the edge region due to the diameter reduction of the material. Construction and function of such a drawing die are commonly known.

Figure 3:
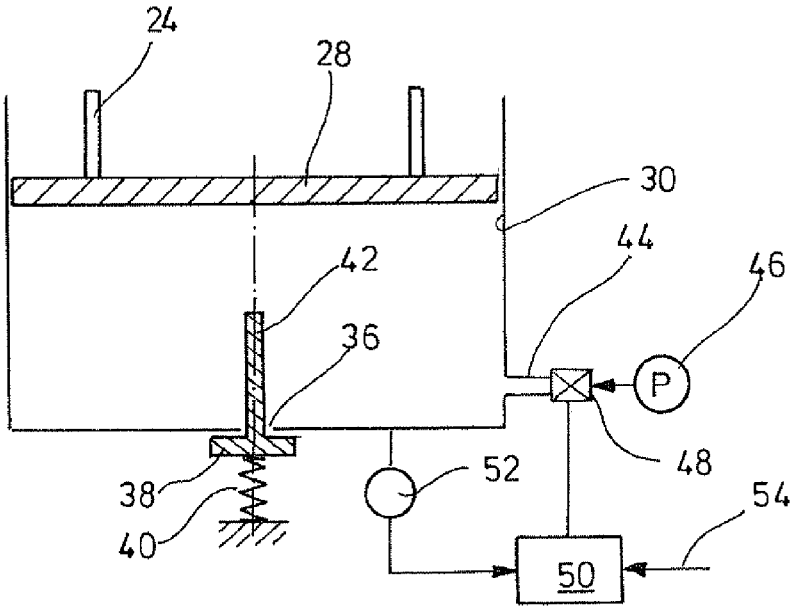
FIG. 3 shows in a schematic view a spring device for the blank holder of the drawing die after FIG. 2.
Figure 4:
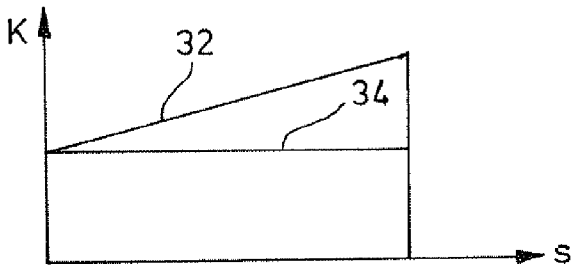
FIG. 4 shows two spring core lines of a spring device for a blank holder of the drawing die after FIG. 2.

In FIG. 3, the force transmission elements 24 after FIG. 2 can be recognised, which co-operate with a piston 28 which sealingly sits in a cylindrical chamber 30. During the deep drawing process, the chamber 30 is filled with gas, for instance with air, preferably under a given pressure. When the blank holder 22 after FIG. 2 is moved downward during the drawing process, the piston 28 moves into the interior of the chamber 30 and compresses the gas cushion, whereby the spring force on the blank holder 22 increases approximately linearly. This is indicated by a characteristic line 32 in FIG. 4, where the spring force is indicated in dependence of the path of the piston 28 or the blank holder 22, respectively. A characteristic line 34 would be obtained when the spring force would be reduced continuously with progressing volume displacement in the chamber 30, like in the state of the art mentioned in the beginning.

In FIG. 3 it is indicated that the bottom of the chamber 36 has an opening, which is normally closed by a valve head 38 which is biased into the locking position by a spring 40. The valve head 38 is provided with an actuation bar 42, which projects into the chamber 30, approximately perpendicular to the extension of the piston 28. When the piston 28 reaches the bar 42, the valve 38 is opened, and the air in the chamber 30 can decompress suddenly, so that the spring force 26 on the blank holder 22 is eliminated within milliseconds. The bar is dimensioned such that it is actuated by the piston 28 when the drawing bell or the blank holder 22, respectively, are immediately before their end position during the drawing process.

The chamber 30 is connected to a pressure source 46 by way of a port 44 via a valve 48. The valve 48 is actuated by a control device 50, which on its part receives a pressure signal by way of a pressure sensor 52 which corresponds to the pressure in the chamber 30, and which receives a further signal via 54 in addition, which indicates when the drawing process is completed and the drawing bell 20 is set back into the starting position. In this point of time, the valve 48 is opened, so that the pressure source 46 can fill the chamber 30 with gas of a given pressure again.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A drawing die for deep drawing blanks which are punched out of sheet metal that is painted or coated with film material into flangeless moulded blanks comprising a drawing bell, a drawing core, a blank holder and a pneumatic spring which applies a spring force to the blank holder, wherein the pneumatic spring is formed by a gas volume in a chamber (30), which is sealingly closed by a piston (28), wherein the piston bears against the blank holder (22) by way of force transmission elements (24), and a venting valve (38) is associated to the chamber (30), wherein the venting valve (38) is actuated when the piston (28) arrives in a predetermined position, whereby the chamber (30) is suddenly vented.

2. A drawing die according to claim 1, wherein the venting valve (38) is adapted to be coupled to a bar or a lever, which projects into the chamber (30) and can be actuated by the piston (28).

3. A drawing die according to claim 1, wherein a pressure source (46) is provided which can be connected to the chamber (30) via an air valve (48), and a control device (50) is provided for the actuation of the air valve (48) after the completion of the drawing process.

4. A drawing die according to claim 1, wherein the spring force is generated by a gas cushion, and the gas cushion is vented towards the atmosphere.

5. A drawing die according to claim 4, wherein after the venting, a space receiving the gas cushion is filled with gas to a predetermined pressure anew.

6. A drawing die according to claim 1, wherein the spring force increases linearly during the drawing process, up to a spontaneous fall-off of the spring force.

7. An apparatus for forming flangeless molded blanks from sheet metal that is painted or coated with film material, said apparatus including:

a) a drawing bell;

b) a drawing core;

c) a blank holder; and d) a pneumatic spring that applies a spring force to said blank holder, said pneumatic spring being formed by a gas volume in a chamber, which chamber is sealingly closed by a piston; said piston being in engagement with said blank holder via force transmission elements; a venting valve is associated to said chamber which is actuated when said piston moves to a predetermined position whereby the chamber is suddenly vented such that the spring force on the blank holder is substantially eliminated.

8. The apparatus according to claim 7, wherein a pressure source is provided which can be connected to the chamber via an air valve, and a control device is provided for the actuation of the air valve after the completion of the drawing process.

9. The apparatus according to claim 7, wherein the venting valve is adapted to be coupled to a bar or a lever, which projects into the chamber and can be actuated by the piston.

10. A drawing die for deep drawing blanks which are punched out of sheet metal that is painted or coated with film material into flangeless moulded blanks comprising a drawing bell, a drawing core, a blank holder and a pneumatic spring which applies a spring force to the blank holder, wherein the pneumatic spring is formed by a gas volume in a chamber (30), which is sealingly closed by a piston (28), wherein the piston bears against the blank holder (22) by way of force transmission elements (24), and a venting valve (38) is associated to the chamber (30), wherein the venting valve (38) is actuated when the piston (28) arrives in a predetermined position, whereby the chamber (30) is suddenly vented such that the spring force applied to the blank holder is reduced to substantially zero.

11. The drawing die of claim 10, whereby the chamber (30) is suddenly vented such that the spring force applied to the blank holder is reduced to zero.

12. An apparatus for forming flangeless molded blanks from sheet metal that is painted or coated with film material, said apparatus including:

a) a drawing bell;

b) a drawing core;

c) a blank holder; and d) a pneumatic spring that applies a spring force to said blank holder, said pneumatic spring being formed by a gas volume in a chamber, which chamber is sealingly closed by a piston; said piston being in engagement with said blank holder via force transmission elements; a venting valve is associated to said chamber which is actuated when said piston moves to a predetermined position whereby the chamber is suddenly vented such that the spring force on the blank holder is substantially eliminated, and wherein, just before the completion of the drawing process, the blank is positioned on the blank holder substantially without pressure.

13. The apparatus of claim 12, wherein the spring force on the blank holder is substantially eliminated within milliseconds.

14. The apparatus of claim 13, wherein the spring force on the blank holder is eliminated within milliseconds.

* * * * *

UNITED STATES PATENT AND TRADEMARK OFFICE

CERTIFICATE OF CORRECTION

PATENT NO. : 9,283,611 B2
APPLICATION NO. : 12/525261
DATED : March 15, 2016
INVENTOR(S) : Thomas Haar It is certified that error appears in the above-identified patent and that said Letters Patent is hereby corrected as shown below:

On the title page item (22) should read as follows:

(22) PCT Filed: Nov. 21, 2007

Signed and Sealed this
Thirty-first Day of May, 2016

Michelle K. Lee

Michelle K. Lee
*Director of the United States Patent and Trademark Office*